United States Patent [19]

Parker

[11] Patent Number: 5,063,631

[45] Date of Patent: Nov. 12, 1991

[54] JANITORIAL APPARATUS

[76] Inventor: Mary E. Parker, P.O. Box 20543, Houston, Tex. 77225

[21] Appl. No.: 544,121

[22] Filed: Jun. 25, 1990

[51] Int. Cl.[5] ..... A47L 13/58

[52] U.S. Cl. ..... 15/263; 15/260; 220/694

[58] Field of Search ..... 15/260, 264, 263; 220/85 R

[56] References Cited

U.S. PATENT DOCUMENTS

| | | | |
|---|---|---|---|
| 1,405,201 | 1/1922 | Gates | 15/263 |
| 1,627,383 | 5/1927 | Gothberg | 15/263 |
| 2,567,708 | 9/1951 | Heber | 15/263 |
| 4,525,892 | 7/1985 | Vayas et al. | 15/263 |
| 4,735,332 | 4/1988 | Thumser | 220/85 R |
| 4,888,847 | 12/1989 | Montijo | 15/263 |

FOREIGN PATENT DOCUMENTS

| | | | |
|---|---|---|---|
| 2504957 | 9/1976 | Fed. Rep. of Germany | 15/260 |
| 1467872 | 12/1966 | France | 15/260 |

*Primary Examiner*—Chris K. Moore
*Attorney, Agent, or Firm*—Vinson & Elkins

[57] ABSTRACT

A mop receptacle for use with a mop bucket used for cleaning wherein the mop receptacle includes an outer body with two sets of a pair of downwardly extending legs each to receive the edge of the bucket therebetween and a pair of support surfaces and an inner body made integral with the outer body and including a plurality of rounded elements which are interconnected to provide a mop basket with a plurality of openings and no solid material catching corners.

7 Claims, 3 Drawing Sheets

JANITORIAL APPARATUS

BACKGROUND

The present invention relates to a janitorial apparatus for use with mops. Specifically the apparatus consists of a bucket element for containing the cleaning fluid and an inverted frustoconical shaped receptacle carried by the bucket for receiving the mop and allowing the person to cause the cleaning fluid to be discharged from the mop into the bucket without any accompanying wringing devices.

Since janitorial services are an important part of building maintenance, and particularly for hospital and nursing home maintenance, it is important to provide a mop bucket with a means of discharging the excess cleaning fluid from the head of the mop before it is removed from the apparatus for cleaning the floors.

Prior mop buckets have had a section formed on its interior from sheets of metal having openings therein and the section is wedge shaped with one of the flat surfaces being pivotally mounted to be moved by its handle toward the other flat surface with the wet mop between the two surfaces so that a normally round mop is squeezed in the rectangular sectional area and the cleaning fluid or water is caused to run from the mop through the holes into the bucket. Such device is difficult to clean and requires the use of a handle and further has the disadvantage of requiring instructions in its operation so that the person does not get caught in the closing surfaces.

Further, the operation of the lever is not done with the person in an erect stance but the person must bend over to grasp and operate the handle which causes the person back strain. Further, the apparatus has closed corners which cause the cleaning difficulty.

Other prior devices have had similar disadvantages including instability of mounting a separate mop receptacle with only three feet. They have had internal ridges which could trap particulate matter which creates an unclean environment unsuitable for use where sanitary conditions are desired.

Other prior mop head draining apparatus includes the lever type of squeezing and corners which trap particulate matter creating an unclean environment, require maintenance and the other disadvantages mentioned above.

SUMMARY

The present invention relates to a janitorial apparatus which includes a mop receptacle for mounting on a bucket suitable for receiving the mop head and the cleaning fluid expressed therefrom and the mop receiving receptacle has an elliptical, frustoconical shape with drainage holes extending through the sides and bottom to permit the fluid expressed from the mop head which is inserted therein with a downward and twisting motion. This mop receiving receptacle also has two split legs with a bucket receiving opening therebetween and a pair of surfaces for engaging the top of the bucket with the surfaces being diagonally across the receptacle from the legs. This receptacle includes smooth inner sides formed by rounded vertical and horizontal members forming a mop receiving frustoconical basket and with an upper surface sloping downward and inward so that all cleaning fluids drain through the openings between the rounded members. The mop receiving basket is sufficiently deep and wide to allow the mop head to be received therein.

An object of the present invention is to provide an improved mop receiving receptacle to be used in a mop bucket which has no corners for trapping particulate matter.

Another object of the present invention is to provide an improved mop receiving receptacle for use with a mop bucket which allows simple and quick wringing of cleaning fluids from the mop head.

A further object of the present invention is to provide an improved mop receiving receptacle for use with a mop bucket which does not require movement of a lever or other mechanical device for the wringing of the mop head.

A still further object of the present invention is to provide an improved mop receiving receptacle for use with a mop bucket which does not require any maintenance other than rinsing after use.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
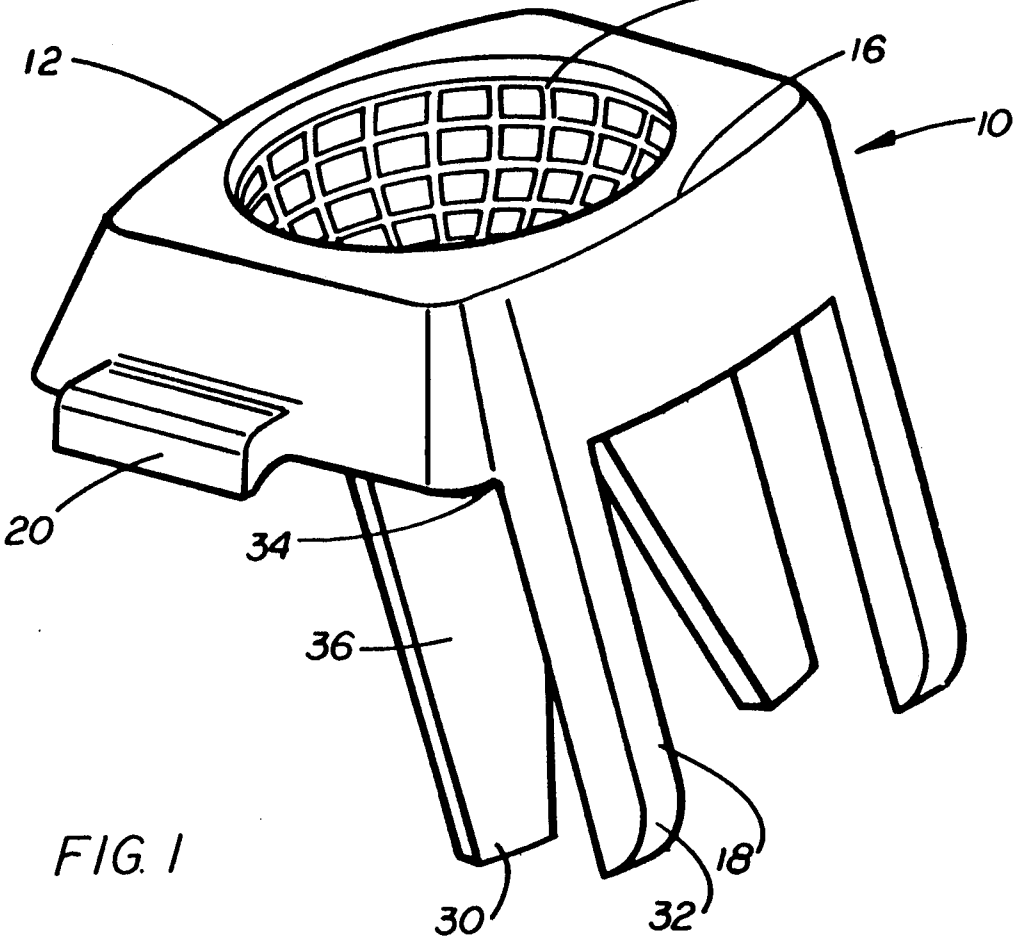
FIG. 1 is a perspective view of the improved mop receptacle of the present invention.
Figure 2:
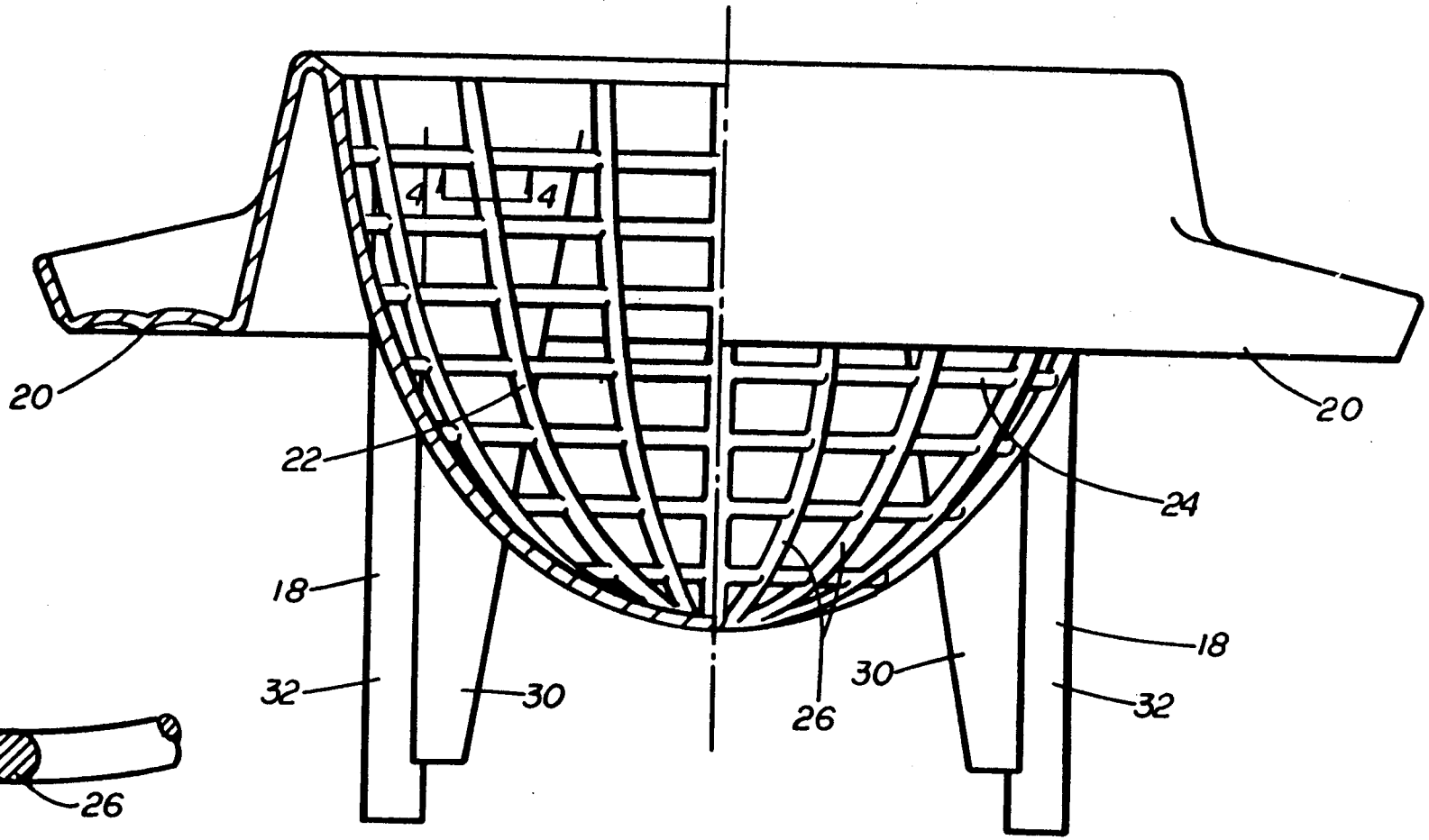
FIG. 2 is an elevation view partly in section of the improved mop receptacle of the present invention.
Figure 4:
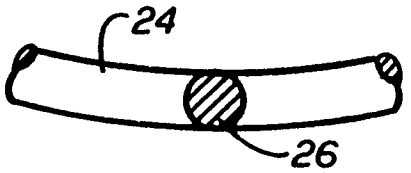
FIG. 4 is a sectional view taken along line 4—4 in FIG. 2.
Figure 3:
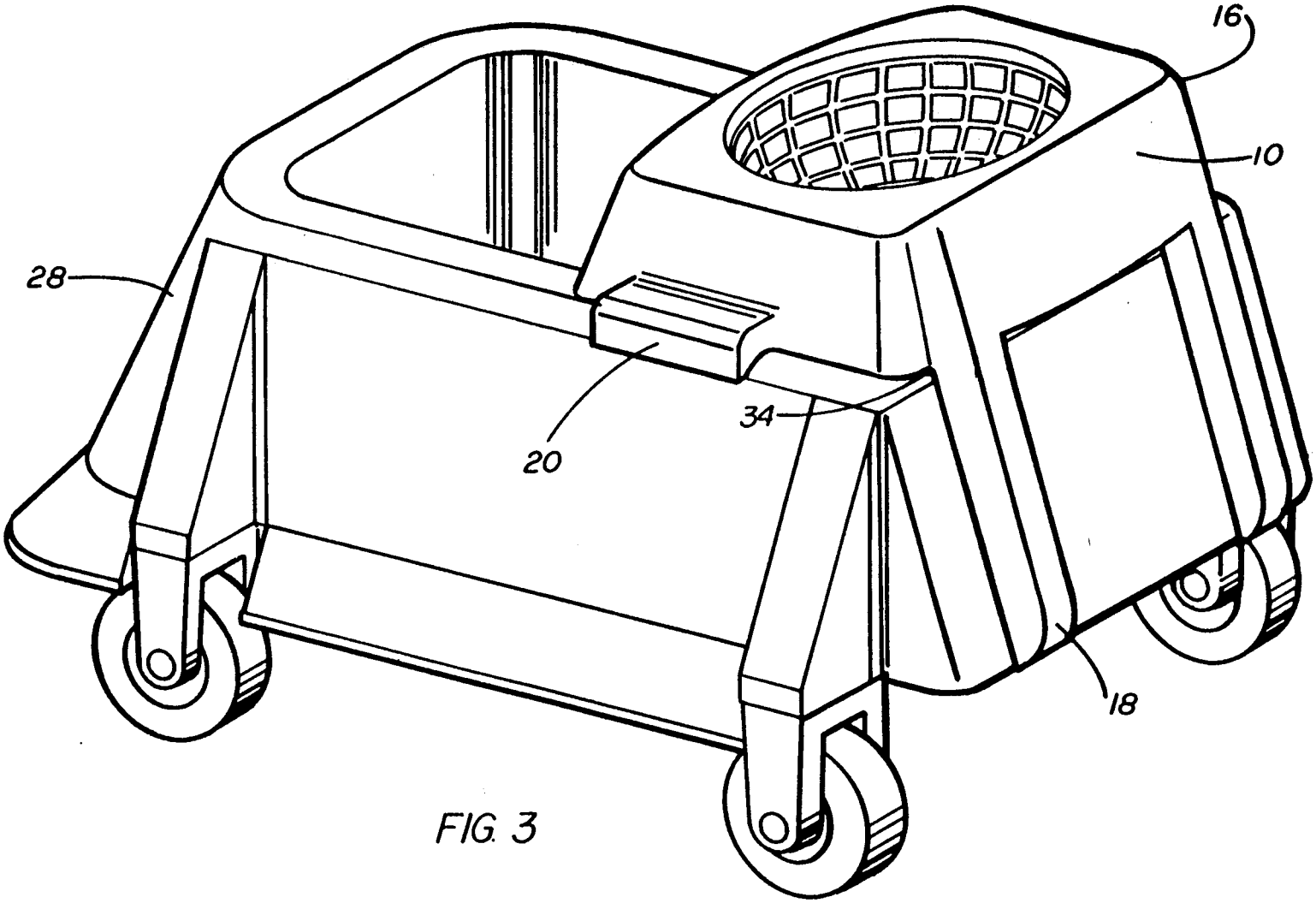
FIG. 3 is a perspective view illustrating the improved mop receptacle of the present invention installed in a mop bucket.

Mop receptacle 10 as shown in the drawings includes outer body 12, inner body 14 defining mop receiving basket 16, two split legs 18 and two support flanges 20. Outer body 12 is shaped to provide the structural connection between legs 18, support flanges 20 and inner body 14. The upper end of outer body 12 slopes downwardly and inwardly to its connection to inner body 14. Inner body 14 includes an openwork structure of a plurality of interconnected elements 22 which are round in section as shown in FIGURE 4. As shown in FIGS. 1, 2 and 3 elements 22 include a plurality of generally horizontal rings 24 of smaller sizes in the lower portion of body 14 and arcuate struts 26 connecting to the rings 24 to form the mop receiving basket 16. As shown in the drawings, the opening provided thereby is generally oval shaped so that it will accommodate the generally rectangular or oval shape of commercial mops. Other prior mop receptacles have been round and either have to be substantially larger to accommodate commercial mops or are limited to smaller mops.

Receptacle 10 may be installed on existing cleaning buckets, such as bucket 28 as shown in FIG. 3. When installed on bucket 28, split legs 18, which include inner leg 30 and outer leg 32 are installed on bucket 28 so that inner leg 30 is positioned within bucket 28 and outer leg 32 is positioned on the exterior of bucket 28 and so that bucket 28 engages the surface 34 at the upper end of the space 36 between inner leg 30 and outer leg 32. Also, the upper edge of bucket 28 is engaged by the lower surfaces of support flanges 20 as shown. In this position, mop receptacle 10 is secured within bucket 28 and can be used for the wringing of cleaning fluid, such as water and detergent, from the mop head by simply inserting the mop head within mop receiving basket 16 with a twisting motion while exerting a downward force on the mop handle. This will cause the cleaning fluids to be expressed from the mop head together with any materials picked up by the mop during mopping. Since elements 22 are of rounded structure and mop receiving basket 16 does not include any corners where solid material can collect, the solid material together with other entrained solids and liquids are immediately drained from mop receptacle 12 into bucket 28. Because of the connection of mop receptacle 10 with bucket 28, mop receptacle is stable and is sufficiently strong so that considerable force can be applied to the mop head during the wringing step to ensure removal of all of substantially all of the fluids which are desired to be removed. The support by leg 18 and support flanges 20 of receptacle 10 on bucket 28 provides the solid, stable and strong support of receptacle 10 on bucket 28.

Receptacle 10 is preferred to be of a unitary construction, such as may be achieved by injection molding the entire structure or any other suitable manufacturing process. The material is preferred to be a material which may be injection molded or other material which is suitable for the manufacturing process and which will withstand the elements to which it is to be exposed, such as the cleaning fluids (soap, detergents etc.) and the sanitizing or disinfecting fluids. A suitable material is a polypropylene.

The advantages of the present invention are that it is of a one piece construction with no moving parts which does not require maintenance other than normal rinsing after use. It is constructed so that the parts may be stacked when not in use for shipping or storage and they are relatively light weight as compared to the prior metal mop bucket wringing structures.

What is claimed is:

1. A mop receptacle for use with a mop bucket comprising an inner body, and an outer body connected to the inner body and having a plurality of split legs each having an inner leg and an outer leg, the inner legs to be engaged within the mop bucket and the outer legs to be on the exterior of the mop bucket, and a plurality of support surfaces spaced from said split legs to engage the upper surface of the bucket at points spaced from said split legs to provide a stable support for the receptacle on the bucket, said inner body forming a bowl with a plurality of openings therethrough.

2. A mop receptacle according to claim 1 wherein said elements of said inner body include a plurality of generally horizontal rings joined by a plurality of arcuate generally vertical connecting struts.

3. The receptacle of claim 1, wherein said inner body is comprised of a material which is inert to cleaning fluids and disinfectants.

4. A mop receptacle according to claim 3 wherein said inner body is comprised of injection molded plastic.

5. A mop receptacle according to claim 4 wherein the plastic of said bodies is polypropylene.

6. The receptacle of claim 1, wherein said inner body comprises a plurality of interconnected elements, said elements each having a rounded cross-section so that there are no material holding corners in said inner body.

7. The receptacle of claim 1, wherein said openings through the bowl are rounded.

* * * * *